US009228380B2

(12) United States Patent
Gerber

(10) Patent No.: US 9,228,380 B2
(45) Date of Patent: Jan. 5, 2016

(54) EXTERIOR DOOR HANDLE SYSTEM IN A MOTOR VEHICLE

(71) Applicant: Dr. Ing. h.c. F. Porsche Aktiengesellschaft, Stuttgart (DE)

(72) Inventor: Harald Gerber, Walheim (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 0 days.

(21) Appl. No.: 14/132,165

(22) Filed: Dec. 18, 2013

(65) Prior Publication Data

US 2014/0167433 A1 Jun. 19, 2014

(30) Foreign Application Priority Data

Dec. 18, 2012 (DE) ..... 10 2012 112 520

(51) Int. Cl.

| | |
|---|---|
| ***E05B 79/06*** | (2014.01) |
| ***E05B 77/44*** | (2014.01) |
| ***E05B 85/16*** | (2014.01) |
| ***E05B 9/08*** | (2006.01) |

(52) U.S. Cl.

CPC ..... *E05B 79/06* (2013.01); *E05B 9/084* (2013.01); *E05B 77/44* (2013.01); *E05B 85/16* (2013.01)

(58) Field of Classification Search

CPC ..... B25G 3/08; B25G 3/12; E05B 79/06; E05B 85/10; E05B 65/20; E05B 9/04; E05B 9/084; E05B 69/04; E05B 69/084; E05B 77/44; E05B 85/16; E05C 7/00

USPC ..... 70/208, 210, 370, 451, 452, 466, 256, 70/257, 381; 292/336.3, DIG. 53, DIG. 54; 296/146.1; 24/570; 16/412

See application file for complete search history.

(56) References Cited

U.S. PATENT DOCUMENTS

| | | | | |
|---|---|---|---|---|
| 4,099,397 | A * | 7/1978 | Dauenbaugh | 70/371 |
| 4,381,656 | A * | 5/1983 | Hayakawa | 70/451 |
| 5,706,554 | A | 1/1998 | Ruckert et al. | |
| 6,401,302 | B1 * | 6/2002 | Josserand et al. | 16/444 |
| 6,494,066 | B2 * | 12/2002 | Muneta | 70/208 |
| 6,523,871 | B1 * | 2/2003 | Josserand | 292/347 |
| 6,568,229 | B1 * | 5/2003 | Heinrich | 70/370 |

(Continued)

FOREIGN PATENT DOCUMENTS

| | | | | |
|---|---|---|---|---|
| DE | 103 40 196 Al | | 3/2005 | |
| DE | 10 2006 020 044 | A | 11/2007 | |
| EP | 0 646 688 | B1 | 12/1996 | |
| EP | 1 255 007 | B1 | 2/2006 | |
| EP | 2562338 | A2 * | 2/2013 | |
| FR | 2915227 | A1 * | 10/2008 | E05B 65/20 |
| JP | 2007526415 | | 9/2007 | |
| JP | 2010025813 | | 2/2010 | |
| WO | 2008025418 | | 3/2008 | |

*Primary Examiner* — Lloyd Gall
*Assistant Examiner* — Amanda L Miller
(74) *Attorney, Agent, or Firm* — Gerald E. Hespos; Michael J. Porco; Matthew T. Hespos

(57) ABSTRACT

An exterior door handle system (2) in a motor vehicle has a bearing bracket (11) on an interior side (10) of an exterior door panel (1) and a door handle (12) on an exterior side (9) of the exterior door panel (1). The door handle (12) is mounted from the exterior and penetrates the exterior door panel (1) for mounting in the bearing bracket (11). A unit (19) formed from a lock barrel (20) and a housing (21) for the lock barrel (20) is mounted in the bearing bracket (11) from the interior and is covered on the exterior side (9) of the exterior door panel (1) by a protective cap (24). A locking clip (30) is mounted in the bearing bracket (11) arranged on the interior side (10) and locks both the unit (19) and the protective cap (24) counter to their respective mounting direction.

5 Claims, 5 Drawing Sheets

(56) References Cited

U.S. PATENT DOCUMENTS

| | | | | |
|---|---|---|---|---|
| 6,834,901 | B2 * | 12/2004 | Low | 296/1.02 |
| 7,100,408 | B2 | 9/2006 | Nakasone | |
| 7,260,964 | B2 * | 8/2007 | Velicanin et al. | 70/208 |
| 7,444,845 | B2 * | 11/2008 | Kargilis et al. | 70/370 |
| 8,746,758 | B2 * | 6/2014 | Savant et al. | 292/336.3 |
| 2003/0038486 | A1 * | 2/2003 | Nomura et al. | 292/336.3 |
| 2010/0000272 | A1 | 1/2010 | Muller et al. | |
| 2010/0325841 | A1 * | 12/2010 | Savant et al. | 16/412 |
| 2012/0216582 | A1 * | 8/2012 | Muller et al. | 70/91 |
| 2012/0228886 | A1 * | 9/2012 | Muller et al. | 292/336.3 |
| 2012/0247161 | A1 * | 10/2012 | Muller et al. | 70/91 |
| 2012/0304542 | A1 * | 12/2012 | Kargilis et al. | 49/460 |

* cited by examiner

EXTERIOR DOOR HANDLE SYSTEM IN A MOTOR VEHICLE

CROSS REFERENCE TO RELATED APPLICATION

This application claims priority under 35 USC 119 to German Patent Appl. No. 10 2012 112 520.1 filed on Dec. 18, 2012, the entire disclosure of which is incorporated herein by reference.

BACKGROUND

1. Field of the Invention

The invention relates to an exterior door handle system in a motor vehicle.

2. Description of the Related Art

A known exterior door handle system includes a bearing bracket arranged on an interior of an exterior door panel and a door handle arranged on an exterior of the exterior door panel. The door handle is mounted from the exterior of the exterior door panel and penetrates the exterior door panel to be mounted in the bearing bracket. A unit that includes a lock barrel and a housing for the lock barrel is mounted in the bearing bracket The unit is mounted from the interior of the exterior door panel and penetrates an opening in the exterior door panel. A protective cap covers the exterior of the exterior door panel and is mounted from the exterior. The protective cap ensures that third parties cannot simply manipulate the exterior door handle system in the region of the lock barrel.

Firm seating of the protective cap and the unit comprising the lock barrel and housing is ensured in the exterior door handle system. This also makes unauthorized manipulations for the purpose of theft more difficult.

It is an object of the invention to develop an exterior door handle system where the protective cap and the unit that comprises the lock barrel and housing are mounted in a manner that is particularly secure against theft and that ensures a particularly fixed connection of these elements to the bearing bracket.

SUMMARY OF THE INVENTION

The invention relates to an exterior door system with a locking clip mounted in a bearing bracket and arranged on the interior side of the exterior door panel. The locking clip locks both the protective cap and the unit that comprises the lock barrel and the housing counter to their respective mounting direction.

The locking clip is moved into a locking position with regard to the unit that comprises the lock barrel and housing and into a locking position with regard to the protective cap, after the protective cap and the unit comprising the lock barrel and housing have been mounted. A positively locking connection is produced between bearing bracket, locking clip, unit and protective cap and prevents the unit and the protective cap from being moved counter to their respective mounting direction. These elements therefore are locked by the locking clip.

A third party may try to manipulate the protective cap. However, the protective cap cannot be pulled off or dismantled counter to the mounting direction of the protective cap due to the action of the locking clip on the protective cap. The same applies to the unit comprising the lock barrel and housing, in relation to their mounting direction due to the action of the locking clip on the unit.

The locking function of the locking clip can be realized with a very simple design of the locking clip. More particularly, the locking clip has a plate-shape that is excellently suitable for bringing about the locking action by introducing the plate into a recess of the bearing bracket being with defined end-side regions engaging behind complementary regions of the unit and protective cap.

The plate-shaped locking clip preferably is formed by a first plate section and a second plate section that are perpendicular to one another. A larger plate section locks to the unit and the protective cap, whereas the other plate section receives, for example, a screw for connecting the plate section to another component, such as the housing of the unit. The locking clip may be locked to the protective cap and to unit that comprises the lock cylinder and housing in a simple manner by a very wide range of configurations of these elements. The housing of the unit preferably has at least one groove that receives the locking clip and may have a plurality of grooves for receiving the locking clip. The protective cap preferably has at least one groove that receives the locking clip and may have a plurality of grooves for receiving the locking clip.

The plate-shaped locking clip preferably is configured to penetrate the at least one groove of the protective cap and/or the at least one groove of the housing. More particularly the plate-shaped locking clip preferably engages the housing and/or the protective cap from at least two sides, and particularly three sides. This engagement of the locking clip into the housing and the protective cap at the plurality of sides achieves particularly high security with regard to unauthorized manipulation of the unit and the protective cap, which follows the aim of moving the unit and/or the protective cap counter to the mounting direction of the respective element.

A screw preferably penetrates a hole in the locking clip and is screwed into the housing to connect the locking clip and housing. The unit that comprises the housing and lock barrel therefore is fixed in the mounting direction, is locked by the locking clip and is connected to the locking clip by the screw. Thus, a particularly fixed connection of the locking clip, protective cap and unit comprising the housing and lock barrel is formed and is secure against theft.

The screw preferably penetrates a hole in the plate section that does not lock with the housing and/or the protective cap. One plate section therefore is given the locking function, whereas the other plate section cooperates with the screw to provide the connecting function of the locking clip and housing of the unit. It is conceivable in principle to connect the locking clip by the screw to another component of the exterior door handle system, such as the bearing bracket. The aim is to achieve a situation where the locking clip cannot be displaced out of its locking position in an unauthorized manner.

The screw expediently is mounted in the hole of the locking clip and is fixed axially by a securing ring connected to the screw. Thus, the locking clip can be pushed back into its non-locking position when screwing of the screw out of the housing of the unit. This is advantageous for maintenance that requires the door to be dismantled in the region of the protective cap and the unit that comprises the housing and lock cylinder.

Further features of the invention result from the appended drawings and the description of the preferred exemplary embodiment illustrated in the drawings, without being restricted hereto.

BRIEF DESCRIPTIONS OF THE DRAWINGS

DETAILED DESCRIPTION OF THE PREFERRED EMBODIMENTS

The illustrated embodiment of the exterior door handle system is used in a passenger motor vehicle in the driver's door that has an exterior door handle and a keyless go system being integrated into it.

Figure 1:
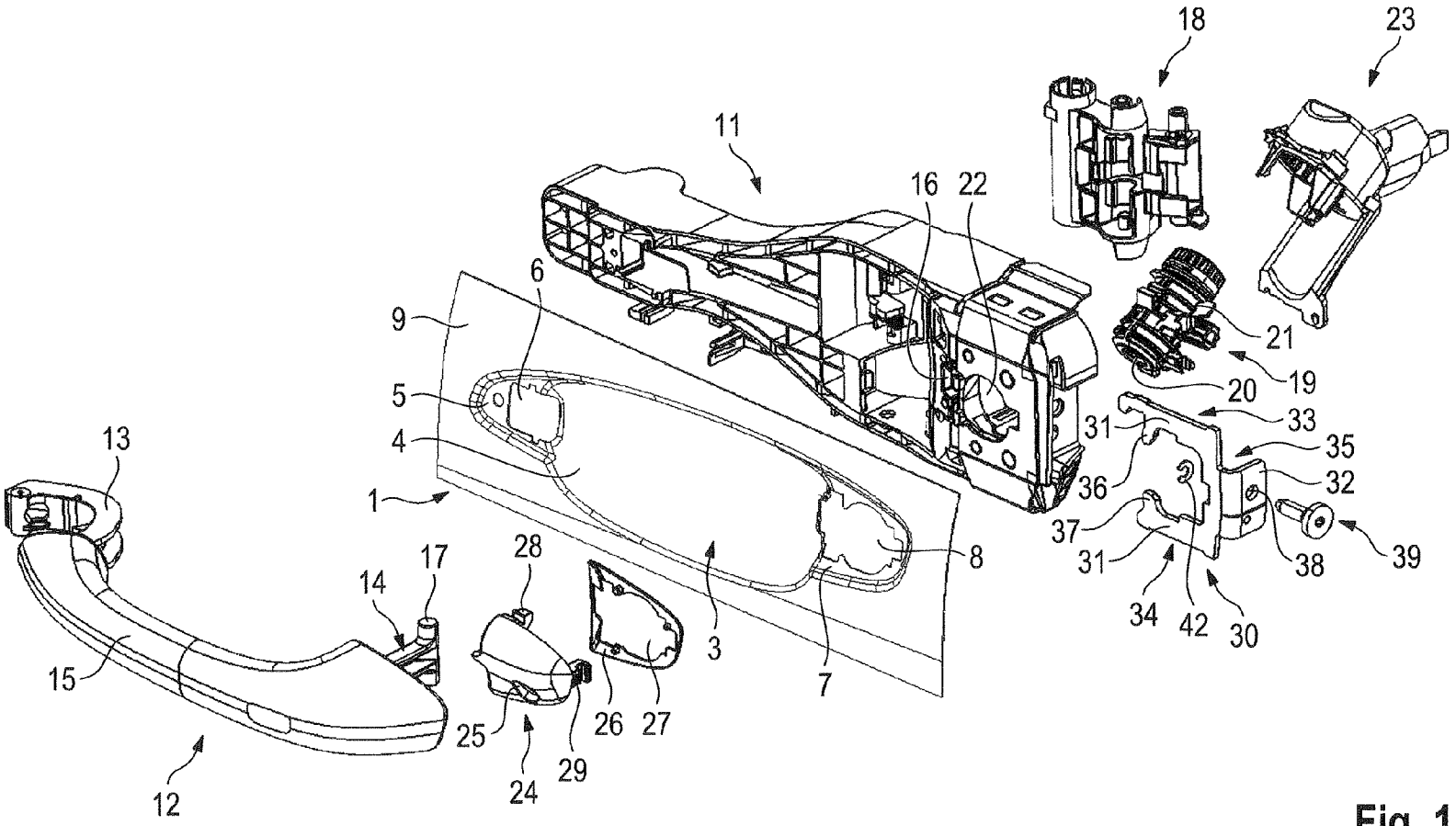
FIG. 1 is an exploded perspective view of an exterior door handle system in a motor vehicle as viewed from the exterior side of an exterior door panel.
Figure 5:
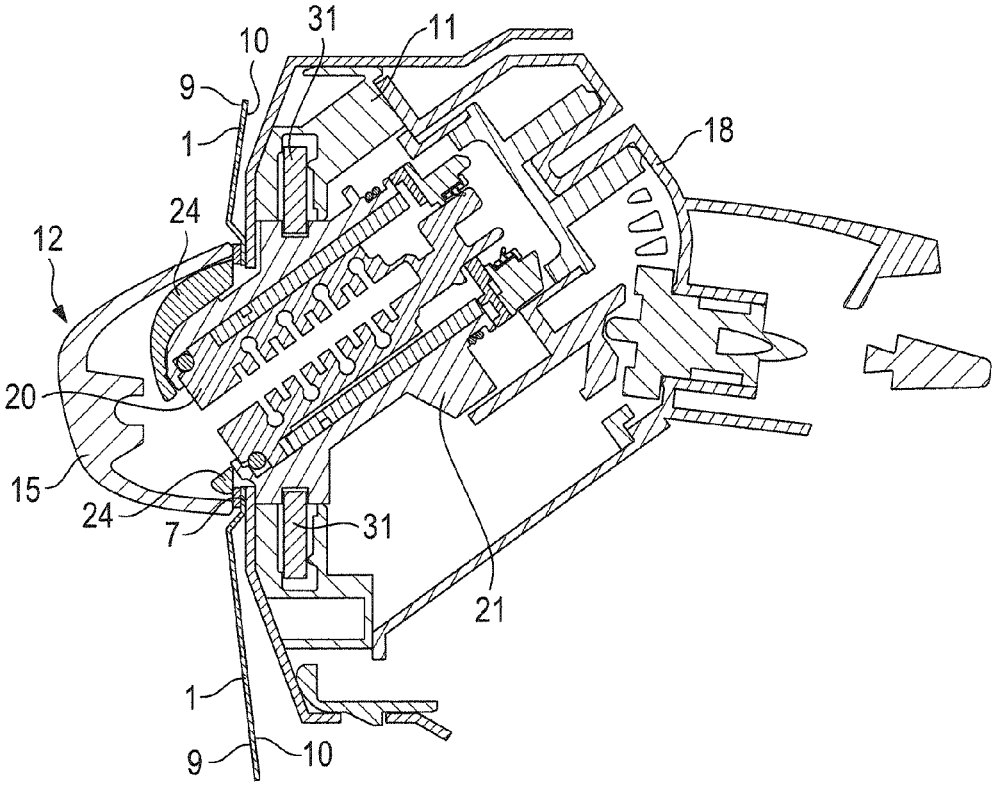
FIG. 5 is a cross-sectional view through the assembled exterior door handle system taken perpendicularly to the exterior door panel in the region of the components shown in FIGS. 3 and 4.

FIG. 1 shows a region of an exterior door panel 1 of the driver's door near an exterior door handle system 2. The exterior door panel 1 has an inwardly curved depression 3 with a large central recessed grip region 4, a recessed region 5 with an opening 6 at the front and a recessed region 7 with an opening 8 at the rear. The exterior side of the exterior door panel 1 is denoted by the designation 9, and the interior side is denoted by the designation 10 (FIG. 5).

Figure 2:
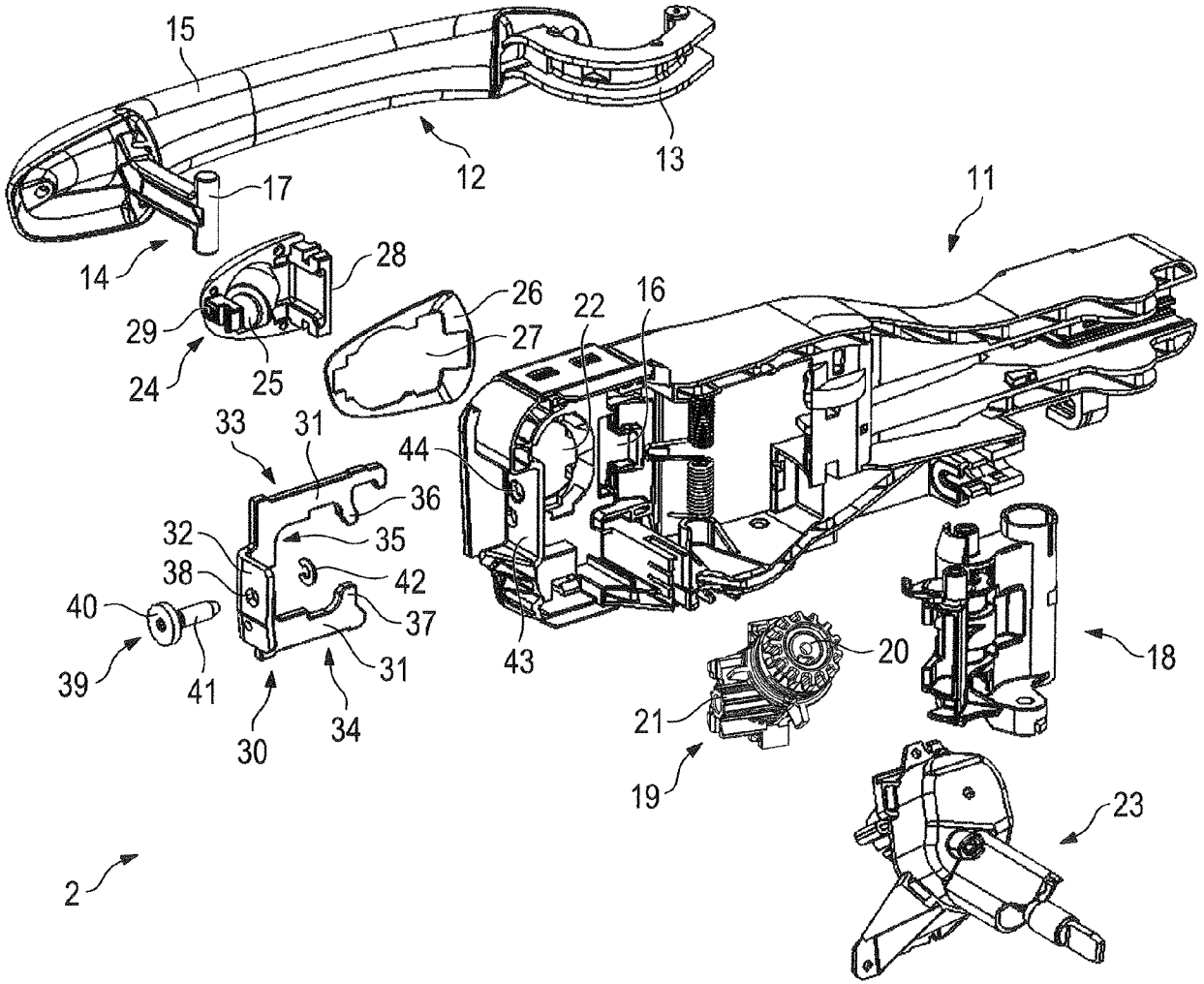
FIG. 2 is an exploded perspective view of the exterior door handle system of FIG. 1 as viewed from the interior side and without the exterior door panel being shown.

As shown in FIGS. 1 and 2, a bearing bracket 11 is arranged on the interior side 10 of the exterior door panel 1 and a door handle 12 is arranged on the exterior side 9 of the exterior door panel 1. The bearing bracket 11 is connected to the exterior door panel 1 by fastening means to mount an inner structure (not illustrated) of the door to the exterior door panel 1.

The door handle 12 has a front bearing bracket 13 that penetrates the front opening 6 in the exterior door panel 1 and a rear actuating projection 14 that penetrates the rear opening 8 in the exterior door panel 1 to mount the door handle 12 on the exterior door panel 1 from the exterior side 9. The door handle 12 has a handle section 15 between the bearing bracket 13 and the actuating projection 14 that enables the door handle 12 to be gripped for opening and closing the door. The bearing bracket 13 enables the door handle 12 to be mounted pivotably in the bearing bracket 11, and the actuating projection 14 penetrates an opening 16 in the bearing bracket 11. The end of the actuating projection 14 remote from the handle section 15 has an actuating pin 17 that is latched to a deflection lever 18 that is mounted in the bearing bracket 13. The deflection lever 18 is connected to a Bowden cable (not shown in greater detail) to actuate a door lock (not illustrated) of the driver's door. The deflection lever 18 is mounted from the interior side 10 of the exterior door panel 1.

A unit 19 formed by a lock barrel 20 and a housing 21 for receiving the lock barrel 20 is mounted in the bearing bracket 11. The unit 19 is mounted from the interior side 10 of the exterior door panel 1, and therefore is on the side of the bearing bracket 13 that faces away from the exterior door panel 1. The housing 21 has an opening 22 that is adjacent to the opening 16 in the bearing bracket 11. A transmission module 23 to the unit 19 is plugged onto the mounted unit 19 from the side of the unit 19 that faces away from the bearing bracket 13. The transmission module 23 transmits the closing function of the lock barrel 20 electrically into a central component of the motor vehicle.

A protective cap 24 is mounted from the exterior side 9 of the exterior door panel 1 and covers the unit 19 on the outside. The protective cap 24 has a hole 25 for introducing a key into the lock barrel 20. An annular sealing element 26 is positioned between the protective cap 24 and the exterior door panel 1. Two projections 28, 29 of the protective cap 24 and the actuating projection 14 penetrate an opening 27 of the sealing element 26.

A locking clip 30 made from steel sheet is mounted in the bearing bracket 13 to produce a fixed connection of the bearing bracket 11, the unit 19 and the protective cap 24 that is secure against theft. The locking clip 30 has a first plate section 31 and a second plate section 32 that are perpendicular to one another and unitary with one another to define a constant wall thickness. The first plate section 31 is punched-out to have a substantially U-shape with two limbs 33, 34 and a crosspiece 35 that connects the limbs 33, 34. Projections 36 and 37 are formed on the limbs 33, 34 and project toward one another. The second plate section 32 has a hole 38 that does not have a thread and through which a screw 39 is inserted. The screw 39 has a screw head 40, a threaded section 41 and an annular groove therebetween for receiving a securing ring 42. When the screw 39 is inserted, the securing ring 42 is arranged on the side of the locking clip 30 that faces the first plate section 31.

The bearing bracket 11 has a slot-shaped receptacle in the region of the openings 16 and 22 for plugging in the region of the first plate section 31 of the locking clip 30. A plate section 43 of the bearing bracket 11 serves as stop face for the plate section 32 of the locking clip 30 and is provided with a hole 44 through which the threaded section 41 of the screw 39 penetrates.

The exterior door handle system 2 is mounted by first connecting the bearing bracket 11 to the exterior door panel 1 and a base structure of the door. Accordingly, the bearing bracket 11 bears against the interior side 10 of the exterior door panel 1. The first plate section 31 of the locking clip 30 then is plugged into the bearing bracket 11, with the screw 40 and securing ring 42 pre-assembled to the locking clip 30. However, the locking clip 30 is not yet inserted so deep that the second plate section 32 contacts the plate section 43 of the bearing bracket 11. The unit 19 comprising the lock cylinder 20 and housing 21 then is plugged into the opening 22 of the bearing bracket 11, and the transmission module 23 is plugged onto the unit 19. Furthermore, the deflection lever 18 is mounted in the bearing bracket 11 from the interior side. Further mounting then takes place from the exterior side. More particularly, the sealing element 26 is placed onto the exterior side of the exterior door panel 1, and then the protective cap 24 is placed onto the sealing element 26. The projections 28 and 29 of the protective cap 24 pass into the region of the locking clip 30. The door handle 12 then is mounted in the bearing bracket 11 in the region of the front pivoting bearing 13 that penetrates the front opening 6 in the exterior door panel 1. Additionally, the actuating projection 14 is guided through the opening 27 in the sealing element 26 and the opening 16 in the bearing bracket 11 so that the actuating pin 17 of the actuating projection 14 comes into a latching connection with the deflection lever 18. In the mounted position of the door handle 12, a rear end region of the handle section 15 covers the protective cap 24, with the coverage being designed so that the lock barrel 20 which penetrates the hole 25 of the protective cap 24 is accessible for inserting the key.

The unit 19 and the protective cap 24 of the exterior door handle system 2 then can be connected with regard to the bearing bracket 11 by displacing the locking clip 30 and connecting the locking clip 30 to the housing 21 of the unit to produce a fixed unit that is secured against theft.

The locking clip 30 that is mounted on the interior side of the door handle 12 in the bearing bracket 11 functions to lock the protective cap 24 and the unit 19 that comprises the lock barrel 20 and housing 21 counter to their respective mounting direction. The housing 21 of the unit 19 has two grooves 45 that can be brought into operative connection with the end sides of the crosspiece region 35 of the first plate section 31 of the locking clip 30. Furthermore, the housing 21 has grooves 46 that can be brought into operative connection with projections 47 of the limbs 33, 34 of the locking clip 30. Furthermore, the projection 28 has two grooves 48 that extend parallel to the axial direction of the screw 39 for engaging the projections 36, 37 of the locking clip 30. The projection 29 of the protective cap 24 also has a groove 49 that can be brought into an operative position with the end of the crosspiece region 35 of the first plate section 31 of the locking clip 30.

When the unit 19 is mounted on the bearing bracket 11 and the protective cap 24 is inserted into the bearing bracket 11, the component formed from the locking clip 30, screw 39 and securing ring 42 is transferred out of its pre-mounting position into its final position. This locks of the unit 19 and protective cap 24 together with the bearing bracket 11.

Figure 3:
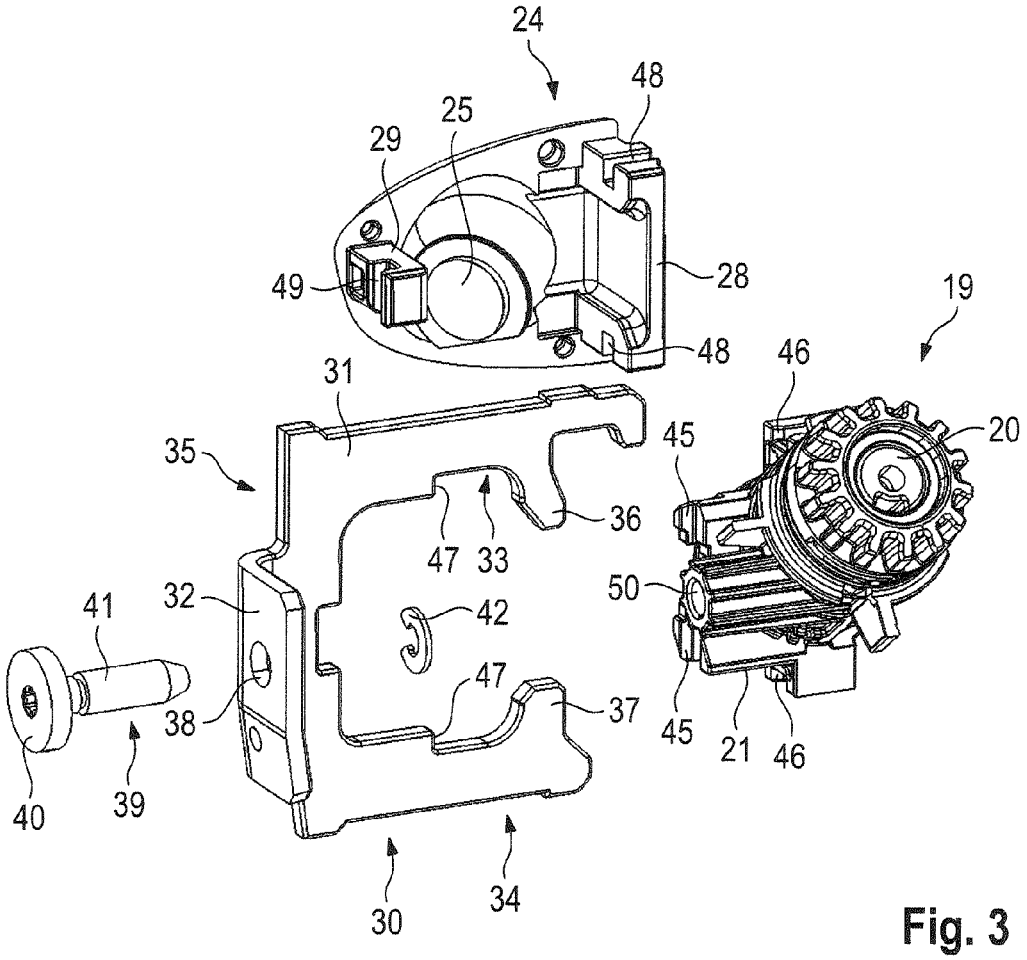
FIG. 3 is an exploded perspective view of a locking clip, a lock barrel, a housing, a protective cap and a screw with securing ring of the door handle system.
Figure 4:
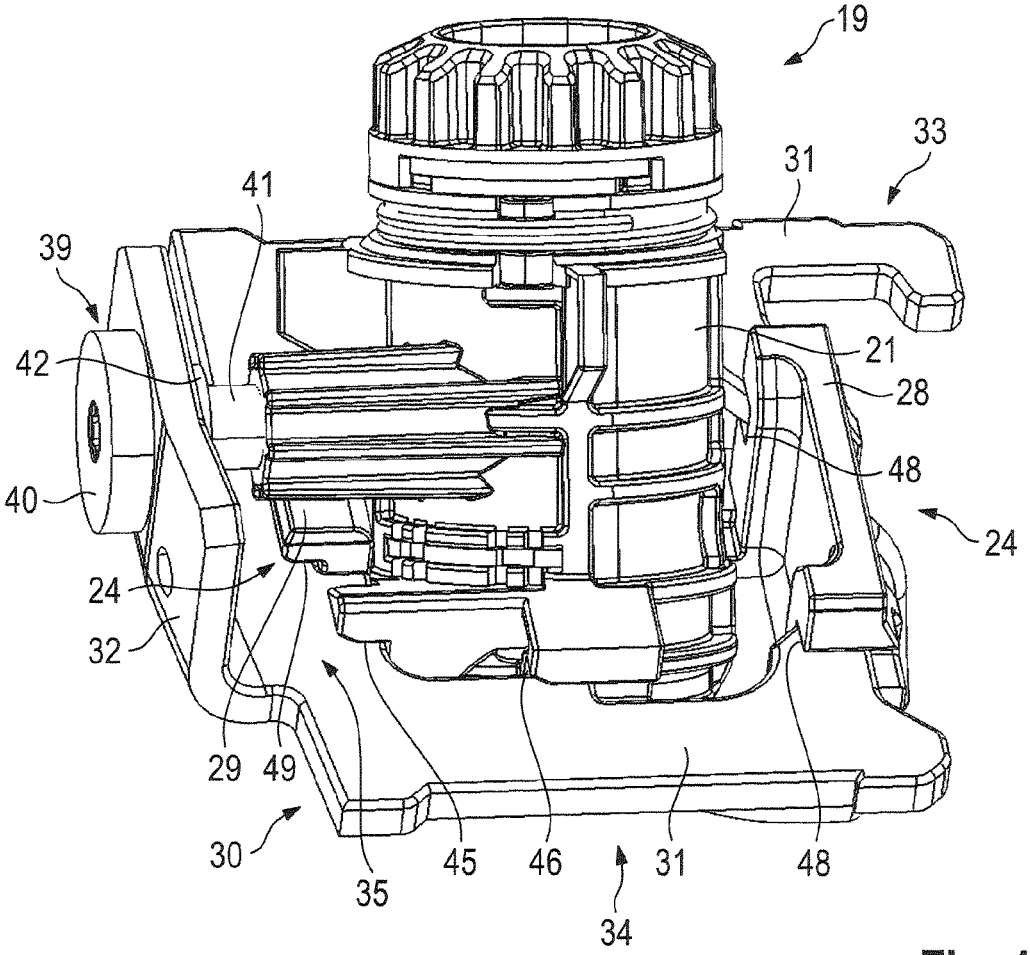
FIG. 4 shows the arrangement of FIG. 3 in the assembled state.

When the locking clip 30 is transferred into said final position, the screw 39 is screwed with its threaded section 41 into a threaded hole 50 of the housing 21 of the unit 19. This screwing-in operation causes the locking clip 30 to be moved in the direction of the housing 21 via the head 40 of the screw 39. Thus, the first plate section 31 of the locking clip 30 moves into the grooves 45 and 46 of the housing 21 and into the grooves 48 and 49 of the protective cap 24. As a result, it is not possible to move the protective cap 24 and the unit 19 perpendicular to the plane of the first plate section 31 of the locking clip 30 so that the locking of unit 19 and protective cap 24 is ensured. The final mounting state of the elements according to FIG. 3 is illustrated in FIG. 4. FIG. 5 illustrates this final mounting state, in relation to the exterior door handle system 2 for the locking region which has been explained in the preceding text.

The arrangement of the screw 39 and securing ring 42 makes it possible, when the screw 39 is screwed out of the threaded hole 50 of the housing 21, to transfer the locking clip 39 into its pre-mounting position again, and thus to displace it correspondingly, with the result that the locking action between the bearing bracket 11, protective cap 24 and unit 19 is canceled.

What is claimed is:

1. An exterior door handle system to be mounted on an exterior door panel of a motor vehicle, the exterior door handle system comprising:

a bearing bracket arranged on an interior side of the exterior door panel, the bearing bracket having an outer surface held substantially in contact with the exterior door panel, an inner surface, a side surface extending between the outer and inner surfaces, an opening formed between the outer and inner surfaces corresponding to an opening formed in the exterior door panel, and a slot-shaped receptacle formed in the side surface in communication with the opening in bearing bracket;

a unit formed from a lock barrel and a housing for the lock barrel, the unit being inserted along an insertion direction into the opening of the bearing bracket from the inner surface of the bearing bracket so that a leading edge of the unit penetrates the opening in the exterior door panel, and an array of coplanar grooves formed in an outer surface of the unit and defining a plane substantially normal to the insertion direction bracket of the unit into the bearing bracket;

a protective cap mounted from an exterior side of the exterior door panel and covering the leading edge of the unit, the protective cap having first and second spaced apart projections projecting through the opening in the exterior door panel, the first projection having two coplanar first grooves facing in opposite directions and the second projection having at least one second groove coplanar with the first grooves, the first and second grooves of the protective cap being coplanar with the coplanar grooves of the unit;

a door handle arranged on the exterior side of the exterior door panel and being mounted to the bearing bracket;

a substantially U-shaped locking clip having a first plate and a second plate that are perpendicular to one another, at least the first plate being configured to be inserted into the receptacle, the first plate of the locking clip having a crosspiece and first and second limbs projecting from the crosspiece and spaced from each other, the crosspiece and the limbs being substantially coplanar, first and second locking piece projections formed respectively on the first and second limbs to project towards each other, and the second plate having a hole penetrating therethrough; and a screw passing through the hole in the second plate of the locking clip, through the bearing bracket and engaged threadedly in the housing of the unit, wherein the crosspiece and the limbs of the locking clip engages plural areas of the at array of grooves of the unit, the crosspiece further engages the at least second groove of the protective cap, and the first and second limbs of the locking clip respectively engage the two oppositely facing first grooves of the protective cap.

2. The exterior door handle system of claim 1, wherein the locking clip is formed from a unitary plate.

3. The exterior door handle system of claim 1, wherein the screw connecting the locking clip and housing, is aligned substantially perpendicular to the insertion direction of the unit.

4. The exterior door handle system of claim 1, wherein the screw mounted in the hole of the locking clip is fixed axially by a securing ring that is connected to the screw.

5. The exterior door handle system of claim 4, wherein the locking clip is composed of steel sheet.

* * * * *